United States Patent [19]

Murdoch

[11] 4,008,886

[45] Feb. 22, 1977

[54] MACHINE TOOLS

[76] Inventor: Peter Murdoch, 5 Oakhurst, London Road, Henfield, Sussex, England

[22] Filed: Oct. 1, 1975

[21] Appl. No.: 618,830

[30] Foreign Application Priority Data

Oct. 2, 1974 United Kingdom ..... 42689/74

[52] U.S. Cl. ..... 269/266; 269/279; 269/282

[51] Int. Cl.² ..... B25B 1/24

[58] Field of Search ..... 269/259, 261, 264, 277, 269/279, 280, 257, 271, 282, 283, 321 ME, 321 A, 266

[56] References Cited

UNITED STATES PATENTS

| | | | |
|---|---|---|---|
| 504,856 | 12/1893 | Aichner | 269/279 |
| 893,875 | 7/1908 | Schneider | 269/277 |
| 1,071,289 | 8/1913 | Bader | 269/280 |
| 1,242,182 | 10/1917 | Hallas | 269/261 |
| 1,278,419 | 12/1918 | Bader | 269/279 |
| 1,371,617 | 3/1921 | Germanow | 269/257 |
| 2,643,563 | 6/1953 | Gaudreau | 269/280 |
| 2,732,745 | 1/1956 | Behr | 269/257 |
| 3,341,190 | 9/1967 | Adamson | 269/271 |

FOREIGN PATENTS OR APPLICATIONS

| | | | |
|---|---|---|---|
| 245,968 | 3/1911 | Germany | 269/283 |
| 889,880 | 9/1953 | Germany | 269/261 |
| 158,244 | 3/1957 | Sweden | 269/266 |

*Primary Examiner*—Al Lawrence Smith
*Assistant Examiner*—Robert C. Watson
*Attorney, Agent, or Firm*—Bacon & Thomas

[57] ABSTRACT

In a machine tool, particularly a milling machine, the workpiece vice is made up from a vice jaw member having a longitudinal track, and a plurality of insert members having profiled portions complementary to the track, so that a desired workpiece engaging profile may be built up from a plurality of insert members which are engaged with the track and fixed in position by locking means.

8 Claims, 5 Drawing Figures

MACHINE TOOLS

This invention concerns improvements in or relating to vices and vice jaws for machine tools, and is particularly although not exclusively applicable to milling machines.

The conventional method of mounting and holding a workpiece securely in a milling machine during the milling operation is by means of a vice which is usually bolted to the work table and between whose jaws the workpiece is clamped. These jaws are designed to withstand the extremely high stresses often involved in milling.

Because a milling machine is required to perform operations on various sizes and shapes of workpiece, interchangeable vice jaws are provided which are of correspondingly different shapes and sizes to ensure accurate registry with a given workpiece to clamp it firmly. Similarly in the case where a workpiece is the subject of a number of milling operations in various orientations and the workpiece presents a different profile to the jaws of the vice in its different orientations, such jaws may need to be interchanged by others of a different size and/or profile to properly accommodate the workpiece in all its desired positions.

The interchangeable jaws are customarily bolted to the vice and, clearly, different jaws have to be made for different purposes. This arrangement has a number of serious disadvantages. Firstly the time taken to interchange the jaws is considerable and this increases the cost of the milling operations.

Secondly the arrangement is uneconomical in the use of steel for two reasons. Whatever profile the jaws present to the workpiece, they must be made of sufficient dimensions to extend between the vice and the workpiece although a large proportion of the steel used does little more than act as a spacer. Furthermore, it can happen that the greater part of a jaw could be used for a plurality of milling operations were it not for an end part which is suitable for one operation but not for the others. In this case complete jaws must be fabricated to suit the different purposes. Again, should a part of a jaw be damaged the whole will need to be replaced, which may involve expensive machining.

A principal object of this invention is to reduce the uneconomical use of steel associated with conventional vice jaws and to a certain extent to simplify their interchangeability.

According to the invention there is provided in or for a machine tool a vice jaw member comprising a body portion, one or more longitudinal parallel grooves being formed in said body portion and providing a track adapted to receive in operation in mating engagement a plurality of vice jaw insert members having a track engaging profile complementary to that of the track, and means for locking a plurality of desired insert members in position in the track to provide a desired workpiece-engaging profile.

It is to be understood that the scope of the invention extends to a vice jaw member as aforesaid per se, either with or without attendent insert members as aforesaid.

It will thus be seen that a desired workpiece-engaging profile may be built up by engaging selected insert members in the track in the desired order and locking them in position. If say one end of the profile becomes damaged or is no longer suitable for a subsequent milling operation, instead of, as heretofore, fabricating a complete new interchangeable vice jaw, all that is now necessary is merely to replace one or more insert members as necessary. This obviously leads to great savings in material costs, and once a comprehensive set of insert members has been built up, the user is in a position to make up a great many combinations of them to serve a multitude of purposes.

The said vice jaw member may be supplied as a fixed part of the machine tool itself, as an attachment for specially constructed vices, or it may in the form of an accessory member which is adapted to be mounted on conventional vices in machines of existing types i.e., in place of conventional vice jaws and serves to "convert" them to the new mode of operation.

The jaw member will preferably comprise a plurality of grooves for a strong and accurate location of the insert members, although arrangements using one groove, e.g. dove-tailed, are also feasible.

The jaw member is preferably generally L-shaped in cross-section so as to give the insert members a good measure of support in the horizontal and vertical directions, although it will be appreciated that other shapes of cross-section may be satisfactory. The L-shaped cross-section is however particularly beneficial since a said groove may be formed on the interior of each limb of the L to form a secure locking arrangement for insert members engaged therewith. The grooves may be rectangular, V-shaped, part circular or re-entrant in cross-section, although square-cut is preferred because of its security of fixing and its simplicity of machining.

It will be appreciated from the foregoing that a desired vice jaw may be built up by engaging a plurality of selected insert members in the track and sliding them along in the desired order to their final position in which they are fixed by said locking means. Various arrangements for the locking means are possible. For example the insert members at each end of the jaw member may be provided with bores through which bolts may be passed and threadedly engaged in threaded bores formed in the jaw member. Alternatively, threaded studs may be threadedly engaged in threaded bores formed in the jaw member and the said end insert members with bores as aforesaid are locked by means of nuts engaging on the studs. This has the advantage that should a thread become crossed or stripped, only the stud needs to be replaced, whereas in the former case the bore would need to be rethreaded.

As, in general, the insert members will be passed into the track from one end only, the other end of the jaw member may be provided with an integral or otherwise fixed stop member instead of a removable insert member. An integral end member may be able to provide a more accurate end location for the insert members. Again, stop members in the form of end plates may if desired be provided at one or both ends of the jaw member. Such plates may be provided with bores to engage said threaded studs as aforesaid.

In a particularly preferred embodiment, designed to accommodate different numbers and/or dimensions of insert members the locking means is made adjustable, and may comprise one or more threaded members which can be threadedly engaged with a fixed or removable end plate, or with the vice jaw member itself. As an example of threaded member, a bolt may be used.

It will be understood that the scope of the invention also extends to an insert member per se, and viewed from another aspect the invention provides an insert member for a vice jaw member according to any of claims 1 to 6 comprising a work piece engaging body portion and a track engaging profiled portion adapted to matingly engage in said track.

In order that the invention may be more readily understood certain embodiments will now be described by way of example with reference to the accompanying drawings. in which.

Figure 1:
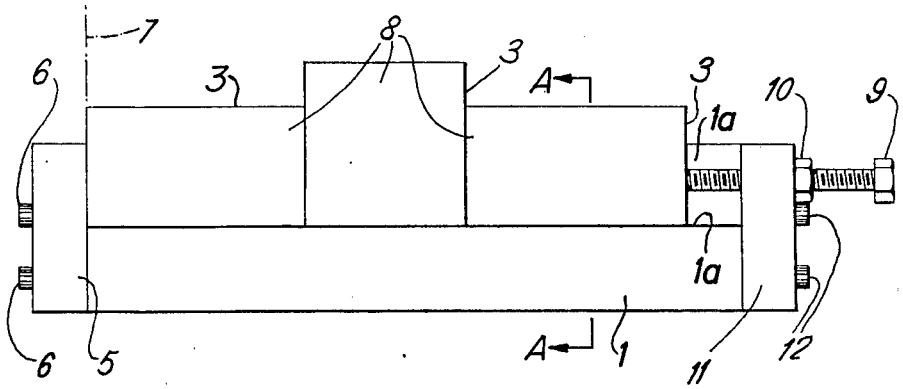
FIG. 1 is a front elevation of a vice jaw assembly.
Figure 2:
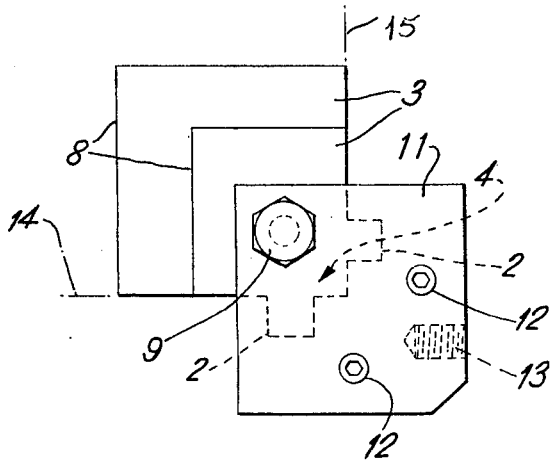
FIG. 2 is an end view of the jaw assembly.

Referring to FIGS. 1 and 2 there is shown a jaw member 1 comprising an elongate body portion of tough steel which is generally of L-shape as seen in FIG. 2. The jaw member is formed with two parallel square section grooves 2 in the interior of the limbs of the L which serve to provide a track or insert supporting surfaces 1*a* for insert members 3. The insert members 3 are machined to an engaging profile 4 which is complementary to the track of the jaw member 1 so that they can matingly engage therewith with substantially no play. A plurality of selected insert members are slid onto the track from the right as seen in FIG. 1 so as to obtain the desired work piece-engaging profile. The extreme left hand insert member as seen in FIG. 1 abuts an end plate 5 which is fixed to the jaw member by bolts 6 and provides a fixed datum in the transverse plane indicated by the line 7.

The profile required for engaging the work piece, i.e., protruding where the work piece is recessed and vice versa, is created by selecting insert members 3 of appropriate dimensions and work piece-engaging faces 8. If necessary, shims can be inserted between the insert members 3 and where the insert members engage the end plate and the locking means to be described in order to obtain the desired spacing in the longitudinal direction.

To lock the insert members in their desired configuration adjustable locking means comprising a bolt 9 is threadedly engaged with the right hand end plate 11 which is bolted to the jaw member by means of bolts 12. A lock nut 10 is also provided and in an alternative arrangement the bolts 6, 12 are replaced by nuts which engage with threaded studs mounted in the jaw member.

Figure 3:
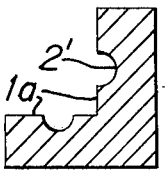
FIGS. 3, 4 and 5 are sectional views along the line A—A of FIG. 1 of various embodiments of jaw member.
Figure 4:
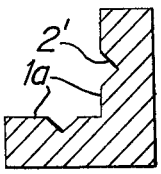
Figure 5:
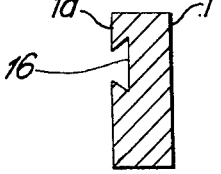

The embodiment shown in designed for use with a conventional milling machine and has threaded bores 13 for the reception of mounting screws. The member will therefore simply replace an existing jaw, but alternatively it could be a part of the machine tool itself. As will be seen from FIG. 2 the jaw member provides fixed datums for the insert members in the horizontal and vertical planes 14, 15 and thus it will be seen that the insert members are very accurately positioned in the jaw member because they have three fixed datums. The receiving track and the complementary profile on the insert members can be machined to extremely fine tolerances providing an accurate spacial positioning of the insert members. FIGS. 3 and 4 show alternate forms of jaw members having part circular and triangular shaped grooves 2′ which replace the square section grooves 2′ of the earlier embodiment, and FIG. 5 shows a jaw member in which the insert member receiving track comprises a single re-entrant groove 16. In this case, the insert members will rest on the bed of the machine tool for support in the downward vertical direction.

What is claimed is:

1. A variable profile vice jaw face member comprising:

a. an elongated base member including a first insert supporting precision tooled surface lying in a plane extending generally transverse to the direction of closing of the jaw face member, the open area immediately in front of the said insert supporting surface defining generally an inset supporting area, the base member extending longitudinally transversely of the direction of opening and closing of the jaw face with the insert supporting area generally facing the direction of closing of said jaw face member;

b. a precision tooled groove area in said insert supporting surface extending longitudinally of the base member and transversely of the direction of closing of the jaw face member;

c. end plates secured to and spaced along the base member blocking the insert supporting area in an endwise sense;

d. at least one insert member disposed in the insert supporting area between the end plates, each insert supporting member having a complementary formed base engaging surface engaging the insert supporting surface of the base member, including the groove area, in contiguous relationship, and a work engaging surface generally facing the direction of closing of the jaw face member; and e. locking means secured to one of said end plates for removably securing each insert member between the end plates within the insert supporting area of the base member.

2. The vice jaw member of claim 1, further wherein the base member includes a second insert supporting precision tooled surface, both insert supporting surfaces being adjacent each other and lying in generally vertically and horizontally extending intersecting planes, the open area between the surfaces defining generally the insert supporting area; a precision tooled grooved area in said second insert supporting surface extending generally transversely of the base member and transversely of the direction of closing of the jaw face member; and each insert member further includes complementary formed base engaging surfaces engaging both said insert supporting surfaces, including the groove areas, in contiguous relationship.

3. The jaw face member of claim 1, further wherein a plurality of insert members are provided, the insert members having work engaging surfaces of varying profile.

4. The jaw face member of claim 1, further wherein the insert member locking means comprises means to apply a squeezing force against one end of one insert member directed towards the other end plate, for locking each insert member between the end plates within the insert supporting area.

5. The jaw face member of claim 4, further wherein said insert member locking means is a bolt threadably secured to its respective end plate for enabling the bolt to be moved towards and away from the opposite end plate when the same is turned.

6. The jaw face member of claim 1, wherein the end plates are provided at opposite ends of the base member, with at least one of the end plates being removably secured to the base member.

7. The jaw face member of claim 1, wherein said groove area has an undercut, generally dovetail configuration, and said insert member includes a complementary protrusion, whereby said insert member is restrained against movement in directions other than longitudinally of the groove by the relationship of the said groove area and complementary protrusion, and further wherein one of said end plates is removably secured to the base member for enabling each insert member to be assembled to the base member by sliding same into place into the insert supporting area from one end of the base member in a direction parallel to the insert supporting surface.

8. The jaw face member of claim 2, wherein one of the end plates is removably secured to the base member to expose the insert supporting area from one end of the base member for enabling each insert member to be assembled to the base member by sliding same into place into the insert supporting area from one end of the base member in a direction parallel to the insert supporting surfaces.

* * * * *